US008770239B2

(12) United States Patent
Sessler

(10) Patent No.: US 8,770,239 B2
(45) Date of Patent: Jul. 8, 2014

(54) FUNNEL FOR FOOD PROCESSING AND RELATED METHOD

(76) Inventor: Jerrod Charles Sessler, Burien, WA (US)

( * ) Notice: Subject to any disclaimer, the term of this patent is extended or adjusted under 35 U.S.C. 154(b) by 319 days.

(21) Appl. No.: 13/361,993

(22) Filed: Jan. 31, 2012

(65) Prior Publication Data

US 2013/0192711 A1 Aug. 1, 2013

(51) Int. Cl.
*B67C 11/02* (2006.01)

(52) U.S. Cl.
CPC ..... *B67C 11/02* (2013.01)
USPC ..... 141/331; 141/338

(58) Field of Classification Search
CPC ..... B67C 11/00; B67C 11/02
USPC ..... 141/331–345
See application file for complete search history.

(56) References Cited

U.S. PATENT DOCUMENTS

| | | | | |
|---|---|---|---|---|
| 590,243 | A * | 9/1897 | Smith | 141/331 |
| 2,083,788 | A * | 6/1937 | Loeber | 7/151 |
| 5,219,006 | A * | 6/1993 | Bishop | 141/1 |
| 5,662,032 | A * | 9/1997 | Baratta | 99/513 |
| 2006/0018189 | A1 * | 1/2006 | Chang Chien | 366/205 |
| 2009/0223596 | A1 * | 9/2009 | Wang | 141/297 |
| 2012/0199245 | A1 * | 8/2012 | Aviles et al. | 141/339 |

* cited by examiner

*Primary Examiner* — Nicolas A Arnett
(74) *Attorney, Agent, or Firm* — Ilya Libenzon

(57) ABSTRACT

A funnel for use in juice making processes and related method of using the funnel are disclosed.

19 Claims, 5 Drawing Sheets

FUNNEL FOR FOOD PROCESSING AND RELATED METHOD

TECHNICAL FIELD

The invention relates to funnels used for food processing. More specifically, the invention relates to funnels for making juice from fruits and vegetables.

BACKGROUND

Juice extraction systems used to make juice from food products such as fruits and vegetables are designed with feeders or chutes to feed the food products through the juicers. However, such systems do not accommodate for loading large portions of food products into chutes, and hence are characterized by slow processing speeds or throughputs. In addition, such systems do not provide for re juicing droppings or exhaust from the juicer. Similarly, prior art funnels are designed to be used with liquid substances, prone to clogging and cannot be efficiently and effectively used with juicers or blenders for processing solid food products such as fruits and vegetables.

SUMMARY

It is therefore an object of the present invention to provide a funnel for juice making processing that allows for loading large quantities of food products thus enabling juicers or blenders to increase processing speed or throughput.

It is further object of the present invention to provide a funnel that enables juice-making systems to re juice droppings or exhaust form the juicer or blender.

It is yet further object of the present invention to provide a funnel that is easy to handle.

The invention features a funnel for use in processing food products such as vegetable and fruits. A funnel comprises a bowl portion having an entrance opening, an intermediate resting portion, and a stem portion having a top opening and an exit opening, wherein the entrance opening is bigger than the top opening and than the exit opening, and the top opening is bigger than the exit opening; wherein the stem portion is connected to the bowl portion by the intermediate resting portion; the intermediate resting portion is flared up from the top opening of the stem portion to the bowl portion at an angle ranging from about 5 degrees to about 20 degrees; the stem portion is tapered down from the top opening to the exit opening; and the entrance opening is in conformance with a shape of the bowl portion.

In one embodiment of the present invention, the exit opening is generally circular and the stem portion is generally cylindrical, with a diameter of the exit opening being about from 3% to about 15% smaller than a diameter of the top opening.

In another embodiment, the exit opening is partially circular having at least one flat portion, and wherein the stem portion is partially cylindrical having at least one corresponding flat sidewall surface extending longitudinally upward from the at least one flat portion to a distance equal to at least about 30% of the height of the stem portion.

In one instance, a diameter of the top opening being about 3% to about 15% bigger than the biggest diameter of the exit opening.

In another instance, the stem portion further comprises a plurality of protrusions extending inwardly from an inner surface of the stem portion.

In one example, a height and a width of the protrusions are in the range from about 5% to about 12% of the diameter of the exit opening.

In another example, the protrusions have either u-shaped or v-shaped profile.

And yet in another example, the protrusions extend longitudinally downward from the top opening of the stem portion to a distance equal to at least about 10% of the height of the stem portion.

In one instance, the protrusions extend longitudinally from the top opening of the stem portion all the way to the exit opening, thereby forming matching protrusions in the exit opening.

In another instance, the bowl portion is generally spherical in shape.

And yet in another instance, the bowl portion is partially spherical in shape.

According to one variant, a shape of the bowl portion is formed by a plurality of flat surfaces and a plurality of generally spherical surfaces.

According to another variant, a height of the stem portion is from about 40% to about 70% of the diameter of the exit opening.

In one embodiment, a height of the stem portion is about 40% to 70% of the biggest diameter of the exit opening.

In another embodiment, the bowl portion, the intermediate resting portion, and the stem portion are non-integrally connected with each other thereby forming a non-monolithical funnel comprised of three separate portions connected together.

And yet in another embodiment, the bowl portion, the intermediate resting portion, and the stem portion are integrally connected with each other thereby forming a monolithical funnel comprised of one part.

In one instance, the bowl portion is integrally connected to the intermediate resting portion thereby forming a monolithical part that is in turn non-integrally connected to the stem portion thereby forming semi-monolithical funnel comprised of two separate parts connected together.

In another instance, the intermediate resting portion is integrally connected to the stem portion thereby forming a monolithical part that is in turn non-integrally connected to the bowl portions thereby forming semi-monolithical funnel comprised of two separate parts connected together.

A method of using a funnel according to the present invention is also disclosed. The method comprises the steps of inserting a funnel into a chute of a juicer or a blender, turning on the juicer or the blender, loading food product into the funnel, processing the food product into a juicy substance or juice, and optionally re-processing the food droppings or exhaust from the juicer or blender.

According to one method, the food product is selected from the group consisting of fruits, vegetables, or combination thereof.

Other aspects, embodiments and features of the invention will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention.

DESCRIPTION OF DRAWINGS

The preceding summary, as well as the following detailed description of the invention, will be better understood when read in conjunction with the attached drawings. For the purpose of illustrating the invention, presently preferred embodiments are shown in the drawings. It should be understood, however, that the invention is not limited to the precise arrangements and instrumentalities shown.

DETAILED DESCRIPTION

Figure 1:
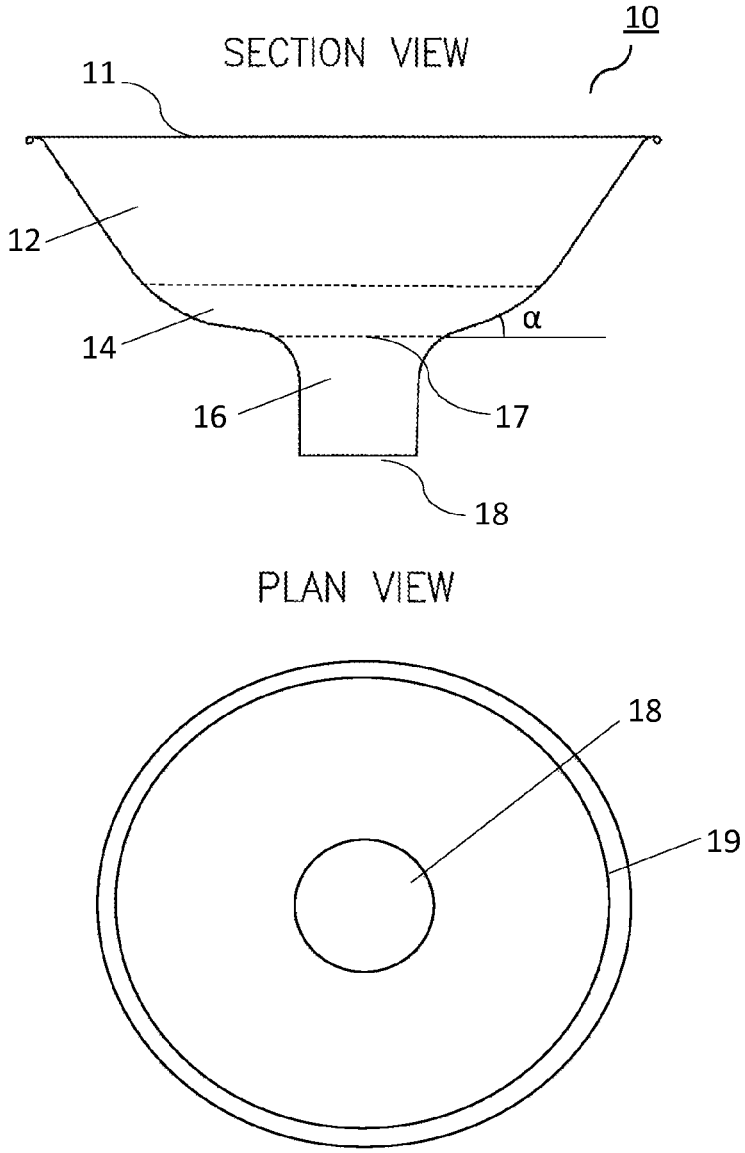
FIG. 1 is a schematic cross-section and a plan view of a funnel in accordance with one preferred embodiment of the present invention.

As illustrated in FIG. 1, the present invention features funnel 10 which is comprised of bowl portion 12 having entrance opening 11, intermediate resting portion 14, and stem portion 16 having top opening 17 and exit opening 18, wherein entrance opening 11 is bigger than top opening 17 and is bigger than exit opening 18, and top opening 17 is bigger than exit opening 18. Stem portion 16 is connected to bowl portion 12 by intermediate resting portion 14. As shown in FIG. 1, intermediate resting portion 14 is flaring up from top opening 17 of stem portion 16 towards bowl portion 12 at an angle $\alpha$ ranging from about 5 degrees to about 20 degrees, preferably from 5 degrees to 15 degrees. It was unexpectedly discovered that the intermediate resting portion with almost horizontal sidewalls flaring up from about 5 degrees to about 20 degrees is needed to prevent food product from being forced into the stem portion too quickly thereby causing a lot of clogging. This design allows loading a large quantity of a food product such as fruits or vegetables into a funnel such that most of the product would rest on the sides of the intermediate resting portion thereby providing for gradual feeding of a food product into the funnel without clogging. According to the present invention, stem portion 16 has a slight taper, tapering down from top opening 17 to exit opening 18.

It was unexpectedly found that such tapering of the stem portion forms a so-called "draft angle," which causes a vortex effect or a suction effect that prevents clogging of the juice processing system during operation. This factor becomes even more pronounced when a funnel of the present invention is used with centrifugal type juicers or blenders operating at high speed. According to the present invention, as shown in FIG. 1, entrance opening 11 can be in conformance with a shape of bowl portion 12. For example, when the shape of the bowl portion is generally spherical (circle 19 in FIG. 1), then the entrance opening is circular. The shape of the bowl portion can be generally spherical, or partially spherical, formed by a plurality of flat surfaces (planes) and a plurality of generally spherical surfaces.

As shown in FIG. 1, exit opening 18 is generally circular and stem portion 16 is generally cylindrical. According to one embodiment of present invention, a diameter of exit opening 18 of stem portion 16 is from about 3% to about 15% smaller than a diameter of top opening 17, preferably from about 3% to about 10% smaller, which creates a tapering angle of the sidewalls of the stem portion causing a vortex effect or a suction effect that prevents clogging of the juice processing system during operation. A height of stem portion 16 can be from about 40% to about 70% of the diameter of exit opening 18 (preferably from about 50% to about 60%, from about %50% to about 70%).

Figure 2:
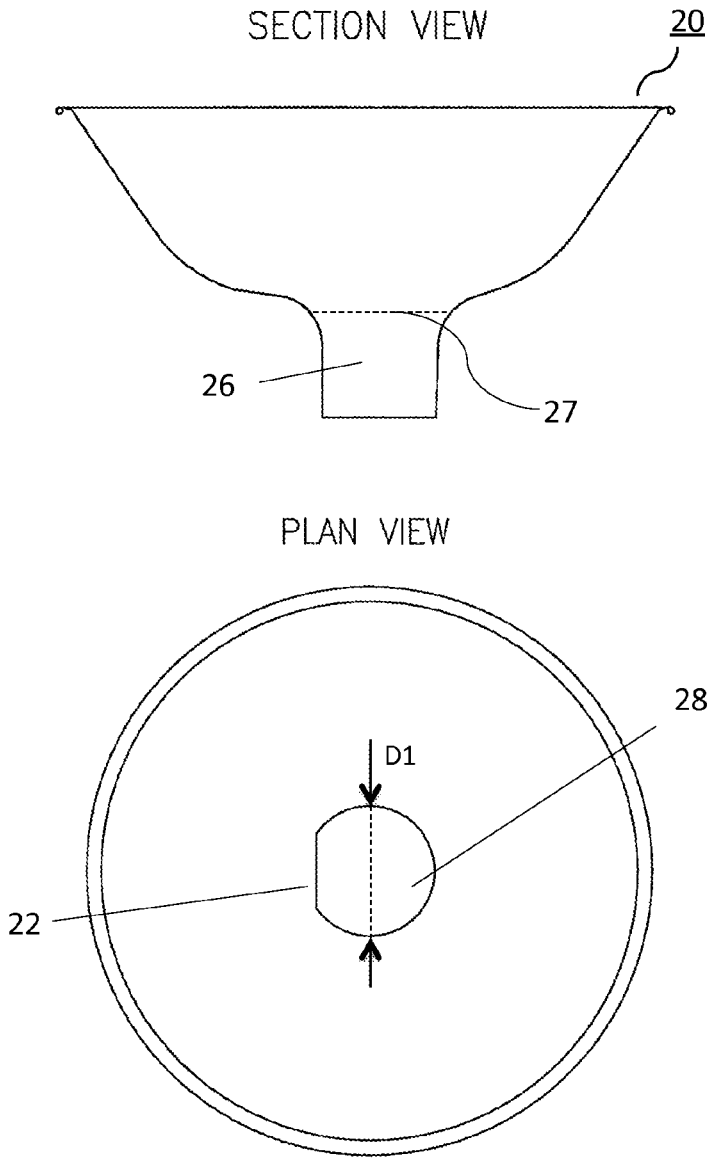
FIG. 2 is a schematic cross-section and a plan view of a funnel in accordance with another preferred embodiment of the present invention.
Figure 3:
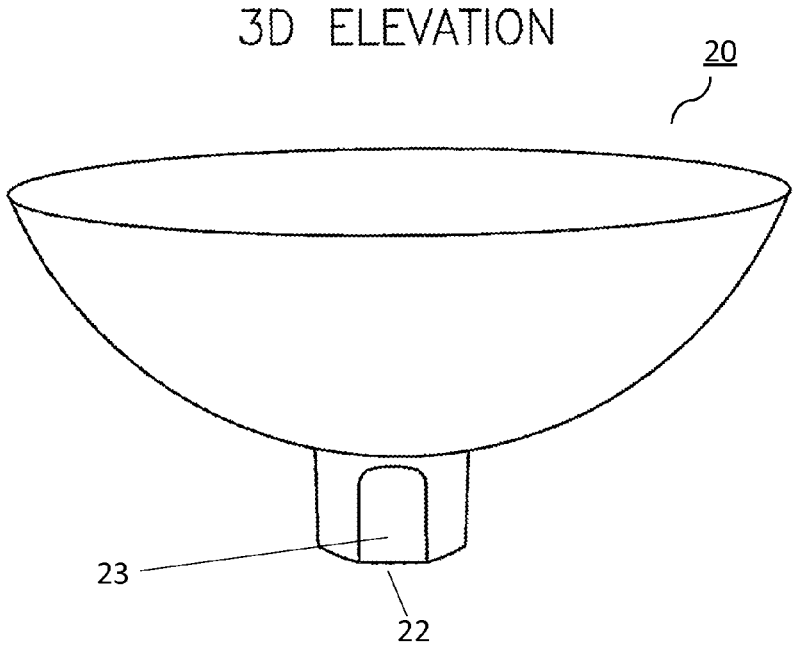
FIG. 3 is a three-dimensional illustration of a funnel in accordance with the preferred embodiment shown in FIG. 2.

FIG. 2 illustrates funnel 20 in accordance with another preferred embodiment of the present invention wherein exit opening 28 is partially circular having one flat portion 22, and wherein stem portion 26 is partially cylindrical having one corresponding flat sidewall surface 23 extending longitudinally upward from flat portion 22 to a distance equal to at least about 30% of the height of the stem portion as illustrated in FIG. 3. It was unexpectedly found that such a design provides for a sufficiently increased airflow thereby causing the product to be sucked through the funnel into a juicer during operation, thus contributing to increased speed of operation or throughput. According to the present invention, there can be more than one flat portion and more than one corresponding flat sidewall surface (two flat portions/surfaces, three flat portions/surface, etc.). According to the present invention, the diameter of top opening 27, as shown in FIG. 2, can be from about 3% to about 15% bigger (preferably from about 3% to about 10% bigger) than the biggest diameter (D1) of exit opening 28. A height of stem portion 26 can be from about 40% to 70% of the biggest diameter (D1) of exit opening 28.

Figure 4:
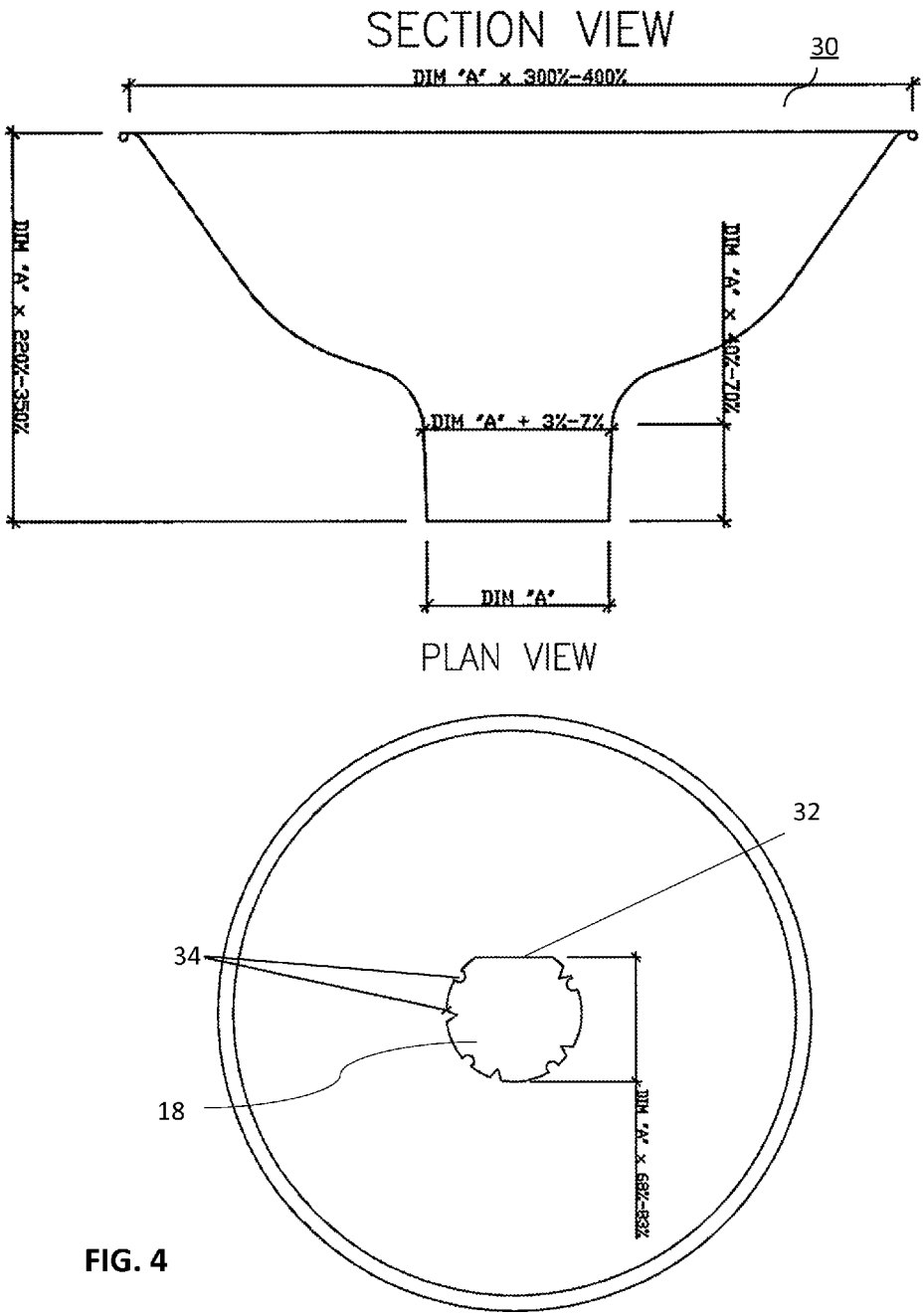
FIG. 4 is a schematic cross-section and a plan view of a funnel in accordance with another preferred embodiment of the present invention.

According to another preferred embodiment of the present invention, the stem portion can comprise a plurality of protrusions 34 extending inwardly from an inner surface of the stem portion, as shown in FIG. 4. The protrusions can preferably have u-shaped or v-shaped profile, however, other profile shapes are contemplated in accordance with the present invention. For example, protrusions can have a profile of a rectangular or square shape. A height and a width of protrusions 34 (FIG. 4) can be in the range from about 5% to about 12% of the diameter (D1 of FIG. 2) of exit opening 18.

Without intent to be bound by this theory, it is contemplated that these protrusions can increase the surface area of the inner walls of the stem portion. It was unexpectedly found that having such protrusions in the stem portion prevents food products such as fruits and vegetables from sticking to the inner walls of the stem portion, which is counterintuitive to the commonly accepted notion that the increased surface area of a substrate generally leads to an increased adhesion.

Figure 5:
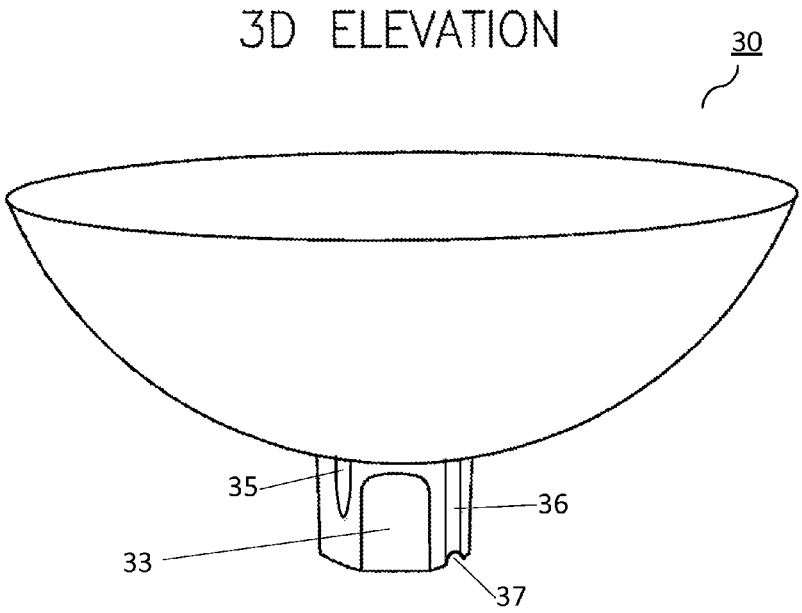
FIG. 5 is a three-dimensional illustration of a funnel in accordance with the preferred embodiment shown in FIG. 4.

Referring to FIG. 5, funnel 30 can feature protrusions 35 which can extend longitudinally downward from the top opening of the stem portion to a distance equal to at least about 10% of the height of the stem portion (i.e., to a distance equal to 20%, 30%, 40%, etc. of the stem's height). As shown in FIG. 5, protrusions 36 can extend longitudinally from the intermediate resting portion of the funnel all the way to the exit opening, thereby forming matching protrusions 37 in the exit opening.

The funnel of the present invention can be made of different materials such as wood, plastics, metals, stainless steel, other suitable materials, or mixture of these materials. The funnel of the present invention can be monolithically made as one part (for example by means of molding process), or can be assembled by attaching separate parts together (for example, by welding separate metal parts together, or gluing separate wooden or plastic parts together). Accordingly, the bowl portion, the intermediate resting portion, and the stem portion can be integrally connected with each other thereby forming a monolithical funnel comprised of one part. Alternatively, the bowl portion can be integrally connected to the intermediate resting portion thereby forming a monolithical part that is in turn non-integrally connected to the stem portion thereby forming a semi-monolithical funnel comprised of two separate parts connected together.

Suitably, the intermediate resting portion can be integrally connected to the stem portion thereby forming a monolithical part that is in turn non-integrally connected to the bowl portions thereby forming a semi-monolithical funnel comprised of two separate parts connected together.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

According to the present invention, the funnel in accordance with all the embodiments described above can be used for juice making process with a juicer or blender as follows. The funnel is inserted into a feeding tube or a chute of a juicer or a blender. Next, the juicer or blender is turned on. Then a food product is loaded into the funnel, and the food product is processed from solid or semisolid form into a juicy substance or juice. The steps of using a funnel can be performed in a different order than described above. For example, the step of turning on a juicer or blender can be done after the step of loading a food product into a funnel. The funnel can be used to re-process the food droppings or exhaust from the juicer or blender, thereby increasing the total juice output. The food products can be fruits or vegetables or combination of fruits and vegetables, or any other food products suitable for juice processing.

What is claimed is:

1. A funnel for use in juice making processes, said funnel comprising: a bowl portion having an entrance opening, an intermediate resting portion, and a stem portion having an inner surface, a top opening and an exit opening, wherein said entrance opening is bigger than said top opening and than said exit opening, and said top opening is bigger than said exit opening;

wherein said stem portion is connected to said bowl portion by said intermediate resting portion;

said intermediate resting portion is flared up from said top opening of said stem portion to said bowl portion at an angle ranging from about 5 degrees to about 20 degrees;

said stem portion is tapered down from said top opening to said exit opening;

said stem portion further comprises at least three unevenly spaced protrusions extending inwardly from the inner surface of said stem portion to prevent food products from sticking to the inner surface of said stem portion;

and said entrance opening is in conformance with a shape of said bowl portion.

2. A funnel according to claim 1, wherein said exit opening is generally circular and said stem portion is generally cylindrical, with a diameter of said exit opening being about from 3% to about 15% smaller than a diameter of said top opening.

3. A funnel according to claim 1, wherein said exit opening is partially circular having at least one flat portion, and wherein said stem portion is partially cylindrical having at least one corresponding flat sidewall surface extending longitudinally upward from said at least one flat portion to a distance equal to at least about 30% of the height of said stem portion.

4. A funnel according to claim 3, wherein the diameter of said top opening being from about 3% to about 15% bigger than the biggest diameter of said exit opening.

5. A funnel according to claim 3, wherein a height of said stem portion is from about 40% to 70% of the biggest diameter of said exit opening.

6. A funnel according to claim 1, wherein a height and a width of said protrusions are in the range from about 5% to about 12% of the diameter of said exit opening.

7. A funnel according to claim 1, wherein said protrusions having either u-shaped or v-shaped profile.

8. A funnel according to claim 1, wherein said protrusions extend longitudinally downward from said top opening of said stem portion to a distance equal to at least about 10% of the height of said stem portion.

9. A funnel according to claim 1, wherein said protrusions extend longitudinally from said top opening of said stem portion all the way to said exit opening, thereby forming matching protrusions in said exit opening.

10. A funnel according to claim 1, wherein said bowl portion is generally spherical in shape.

11. A funnel according to claim 1, wherein said bowl portion is partially spherical in shape.

12. A funnel according to claim 1, wherein a shape of said bowl portion is formed by a plurality of flat surfaces and a plurality of generally spherical surfaces.

13. A funnel according to claim 1, wherein a height of said stem portion is from about 40% to about 70% of the diameter of said exit opening.

14. A funnel according to claim 1, wherein said bowl portion, said intermediate resting portion, and said stem portion are non-integrally connected with each other thereby forming a non-monolithical funnel comprised of three separate portions connected together.

15. A funnel according to claim 1, wherein said bowl portion, said intermediate resting portion, and said stem portion are integrally connected with each other thereby forming a monolithical funnel comprised of one part.

16. A funnel according to claim 1, wherein said bowl portion is integrally connected to said intermediate resting portion thereby forming a monolithical part that is in turn non-integrally connected to said stem portion thereby forming a semi-monolithical funnel comprised of two separate parts connected together.

17. A funnel according to claim 1, wherein said intermediate resting portion is integrally connected to said stem portion thereby forming a monolithical part that is in turn non-integrally connected to said bowl portions thereby forming a semi-monolithical funnel comprised of two separate parts connected together.

18. A method of using a funnel according to claim 1, said method comprising the steps of inserting a funnel into a chute of a juicer or a blender, turning on said juicer or said blender, loading a food product into said funnel, processing said food product into a juicy substance or juice, and optionally re-processing the food droppings or exhaust from the juicer or blender.

19. A method according to claim 18, wherein said food product is selected from the group consisting of fruits, vegetables, or combination thereof.

* * * * *